US008733335B2

(12) United States Patent
Pierce

(10) Patent No.: US 8,733,335 B2
(45) Date of Patent: May 27, 2014

(54) ARCHERY APPARATUS AND METHOD

(76) Inventor: Jim Pierce, Lanark, IL (US)

( * ) Notice: Subject to any disclaimer, the term of this patent is extended or adjusted under 35 U.S.C. 154(b) by 94 days.

(21) Appl. No.: 13/532,150

(22) Filed: Jun. 25, 2012

(65) Prior Publication Data

US 2013/0340736 A1 Dec. 26, 2013

(51) Int. Cl.
*F41B 5/18* (2006.01)

(52) U.S. Cl.
USPC ..... 124/35.2

(58) Field of Classification Search
USPC ..... 124/35.2
See application file for complete search history.

(56) References Cited

U.S. PATENT DOCUMENTS

| | | | | |
|---|---|---|---|---|
| 4,022,181 | A * | 5/1977 | Fletcher | 124/35.2 |
| 4,860,720 | A * | 8/1989 | Todd | 124/35.2 |
| 4,949,698 | A * | 8/1990 | Burnham | 124/35.2 |
| 5,203,314 | A | 4/1993 | Green | |
| 5,205,268 | A | 4/1993 | Savage | |
| 5,243,959 | A | 9/1993 | Savage | |
| 5,497,512 | A | 3/1996 | Wright | |
| 5,615,662 | A * | 4/1997 | Tentler et al. | 124/35.2 |
| 6,205,991 | B1 * | 3/2001 | Summers et al. | 124/35.2 |
| 6,481,431 | B1 * | 11/2002 | Summers | 124/35.2 |
| RE38,833 | E | 10/2005 | Linsmeyer | |
| 7,946,282 | B2 | 5/2011 | Jones | |
| 8,146,578 | B2 | 4/2012 | Jones | |
| 8,453,632 | B2 * | 6/2013 | Immesberger et al. | 124/35.2 |

OTHER PUBLICATIONS

Scott Archery Manufacturing, of Clay City, KY, catalog sheet, pp. 8-9.

* cited by examiner

*Primary Examiner* — John Ricci
(74) *Attorney, Agent, or Firm* — Mark E. Wiemelt

(57) ABSTRACT

An archery apparatus includes a combined adjustable neck support, handle and release mechanism for reducing the amount of force exerted by an archer to maintain a bowstring and associated arrow in a generally fully drawn position. In operation, the release mechanism is secured to the bowstring, the handle is grasped by the drawing hand of the archer, with the other hand of the archer on the bow frame, the bowstring is drawn by the archer to the generally fully drawn position so that the release mechanism is proximate the side of the head of the archer and the neck support is selectively and support-ably disposed against the archer's neck. Thus, both the manual muscular force exerted by the drawing arm of the archer and the force supplied by the neck support are available in tandem for maintaining a bowstring and associated arrow in a generally fully drawn position. The release mechanism is then actuated to provide the normal proper triggering of the arrow into flight.

20 Claims, 4 Drawing Sheets

ARCHERY APPARATUS AND METHOD

CROSS-REFERENCE TO RELATED APPLICATIONS

There are no related applications for this application.

BACKGROUND OF THE INVENTION

1. Field of the Invention

The invention generally relates to archery. More specifically, the invention relates to apparatus for and methods which reduce the amount of force exerted by an archer to maintain a bowstring and associated arrow in a generally fully drawn position.

2. The Prior Art

A significant amount of force is required to maintain a bowstring and associated arrow in a generally fully drawn position. (By generally fully drawn position, Applicant intends to refer to the state of bowstring draw immediately preceding triggering or release of an arrow toward a target.) This force can cause substantial tension and fatigue to the drawing arm of the archer and furthermore can interfere with the smooth motion cycle desired in maintaining a drawn bowstring prior to release of the bowstring and associated arrow for a desired shot. Also bow shooting generally rewards consistent accuracy and precision, which may become affected by arm tension and fatigue. There is no satisfactory known solution to this problem provided in the prior art. Nor is there any suitable way known in the prior art for permitting an archer to maintain a bowstring and associated arrow in a generally fully drawn position with considerably less force on the drawing arm than with conventional bows.

It is therefore an objective of this invention to provide apparatus and methods for reducing the force required by an archer to maintain a bowstring and associated arrow in a generally fully drawn position.

SUMMARY OF THE INVENTION

This invention reduces the force required by an archer to maintain a bowstring and associated arrow in a generally fully drawn position thereby reducing arm tension and fatigue accompanying the draw and facilitating good bowmanship, accuracy and precision. Reduction in the force required by an archer to maintain a bowstring and associated arrow in a generally fully drawn position is achieved by using the archer's neck to partially support the drawn bowstring and associated arrow.

In a preferred embodiment of the invention a combined adjustable neck support, handle and release mechanism are provided for maintaining a bowstring and associated arrow in a generally fully drawn position.

In operation, the release mechanism is secured to the bowstring, the handle is grasped by the drawing hand of the archer, with the other hand of the archer on the bow frame, the bowstring is drawn by the archer to the generally fully drawn position so that the release mechanism is proximate the side of the head of the archer and the neck support is selectively and supportably disposed against the archer's neck. Thus, both the manual muscular force exerted by the drawing arm of the archer and the force supplied by the neck support are available in tandem for maintaining a bowstring and associated arrow in a generally fully drawn position. After aiming of the arrow, the release mechanism is actuated to provide the normal proper triggering of the arrow into flight.

One aspect of the invention provides apparatus and methods for reducing the force required by an archer to maintain a bowstring and associated arrow in a generally fully drawn position.

Another aspect of the invention provides apparatus and methods for facilitating an archer's ability to hold the bowstring and associated arrow in a generally fully drawn position longer than with conventional hand-held releases.

Another aspect of the invention provides apparatus and methods for facilitating good bowmanship, accuracy and precision by reducing tension and fatigue to the drawing arm of the archer.

Another aspect of the invention provides apparatus and methods for establishing a consistent anchor point for the release mechanism.

Other features, objectives and advantages of the invention will be found throughout the following description, claims and accompanying drawing.

It is therefore an object of the invention to provide apparatus and methods for reducing the force required by an archer to maintain a bowstring and associated arrow in a generally fully drawn position.

It is another object of the present invention to provide apparatus and methods for facilitating an archer's ability to hold the bowstring and associated arrow in a generally fully drawn position longer than with conventional hand-held releases.

It is yet another object of the present invention to provide apparatus and methods for facilitating good bowmanship, accuracy and precision by reducing tension and fatigue to the drawing arm of the archer.

It is yet another object of the present invention to provide provides apparatus and methods for establishing a consistent anchor point for the release mechanism.

These together with other objects of the present invention, along with the various features of novelty which characterize the present invention, are pointed out with particularity in the claims annexed to and forming a part of this disclosure. For a better understanding of the present invention, its operating advantages and the specific objects attained by its uses, reference should be had to the accompanying drawings and descriptive matter in which there is illustrated a preferred embodiment of the present invention and alternative embodiments.

Before explaining the preferred embodiment and alternative embodiments of the present invention in detail, it is to be understood that the present invention is not limited in its application to the details of construction, to the arrangements of the components set forth in the following description or illustrated in the drawings, or to the methods described therein. The present invention is capable of other embodiments and of being practiced and carried out in various ways. Also, it is to be understood that the phraseology and terminology employed herein are for the purpose of description and should not be regarded as limiting.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the present invention in any way.

DETAILED DESCRIPTION OF THE PREFERRED EMBODIMENT

Figure 1:
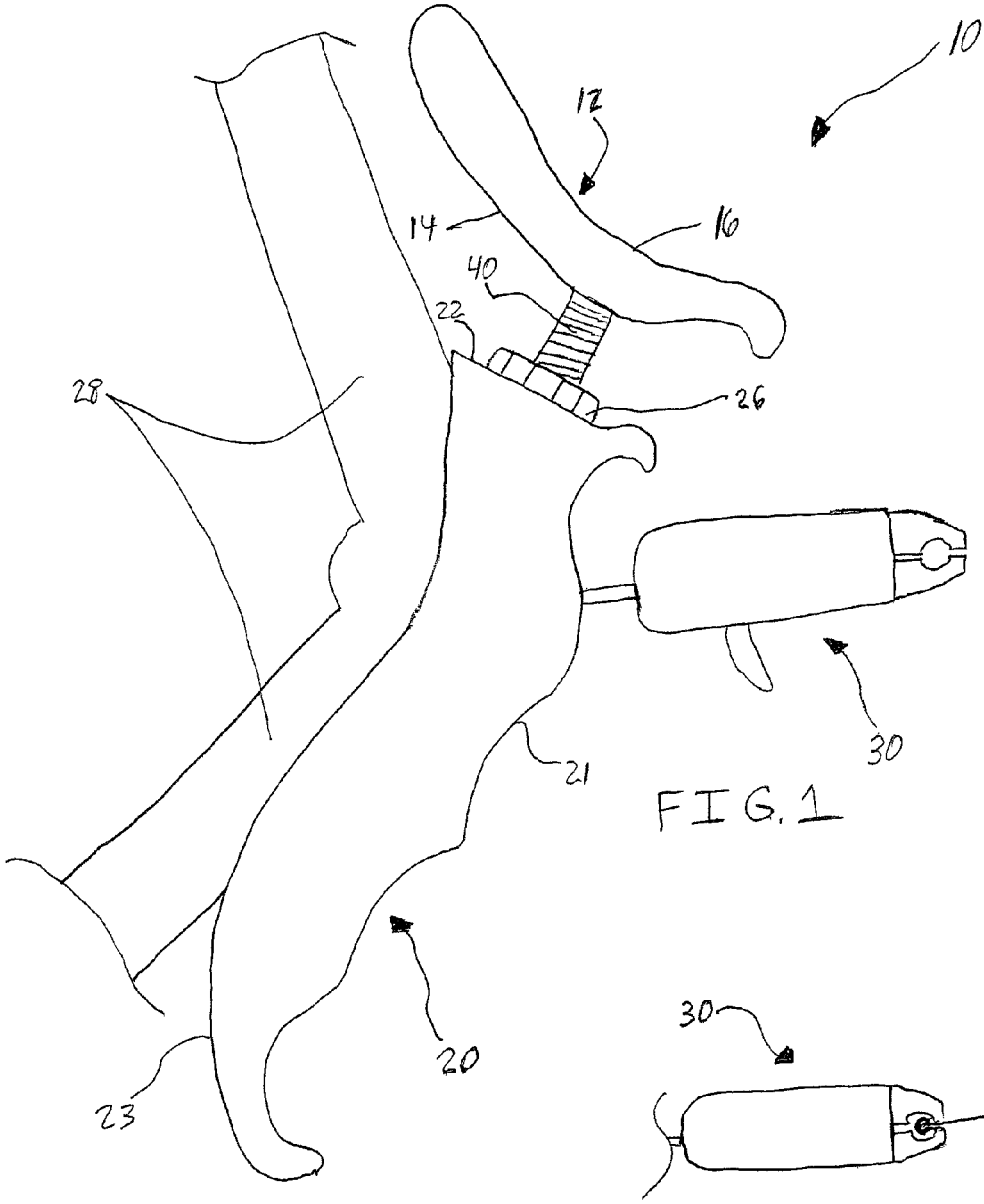
FIG. 1 is a top plan view of an archery apparatus having a combined adjustable neck support, handle and release mechanism in accordance with preferred embodiment of the invention.
Figure 2:
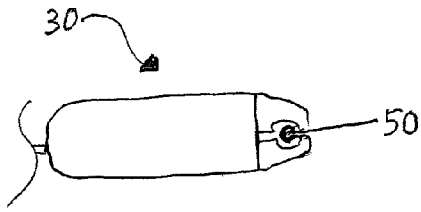
FIG. 2 is a top plan view, partially broken away of a release mechanism provided in accordance with the preferred embodiment of the invention secured to a bowstring.
Figure 3:
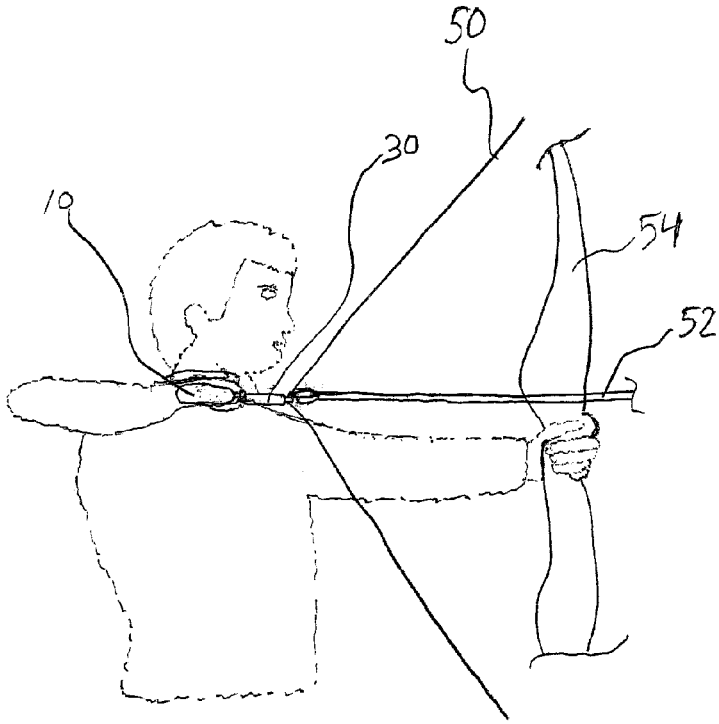
FIG. 3 is a side elevational view, partially broken away of an archer maintaining a bowstring and associated arrow in a generally fully drawn position with an archery apparatus provided in accordance with the preferred embodiment of the invention.
Figure 4:
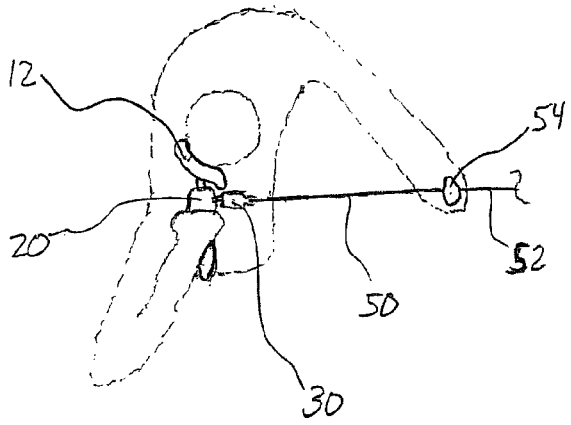
FIG. 4 is a top plan view, partially broken away of an archer maintaining a bowstring and associated arrow in a generally fully drawn position with an archery apparatus provided in accordance with the preferred embodiment of the invention.

While this present invention is susceptible of embodiments in many different forms, there are shown in the drawings and will be described in detail herein, a preferred embodiment, with like parts designated by like reference numerals and with the understanding that the present disclosure is to be considered as an exemplification of the principles of the present invention, and is not intended to limit the claims to the illustrated preferred embodiment.

Referring now to FIGS. 1-4, a preferred embodiment of the archery apparatus 10 includes a combined neck support 12, handle 20 and release mechanism 30 for maintaining a bowstring 50 and associated arrow 52 in a generally fully drawn position. The neck support has a first side 14 and a second side 16. The handle has a first end 22. An adjustable member 40 is disposed in cooperative engagement between the first side 14 of the neck support 12 and the first end 22 of the handle 20.

In the preferred embodiment, the adjustable member 40 includes a threaded bolt 42 which is partially disposed in a threaded recess 24 (not shown) of the handle 20. It should also be readily understood by those skilled in the art that the neck support 12 may include the threaded recess 24 for partially receiving the threaded bolt 42, or both the neck support 12 and the handle 20 may each include a threaded recess 24 for partially receiving the threaded bolt 42. It should also be readily understood by those skilled in the art that the adjustable member 40 may be any suitable length adjusting means, such as a sliding or telescoping member, without departing from the scope and spirit of the invention.

In the preferred embodiment, the neck support 12 and handle 20 are constructed of polymer materials, although it should be readily understood by those skilled in the art that other suitable materials, such as aluminum or stainless steel, may be employed without departing from the scope and spirit of the invention. In the preferred embodiment of the archery apparatus 10, the neck support 12 and handle 20 are secured in spaced relationship by a lock nut 26 disposed on the adjustable member 40. The release mechanism 30 is pivotally attached to a first side 21 of the handle 20. Securing means 28 are attached to a second side 23 of the handle 20 for selectively and releasably securing the handle 20 to a wrist of an archer. In the preferred embodiment, the securing means 28 comprise Velcro® wrist straps, although it should be readily understood by those skilled in the art that the securing means 28 may comprise any other suitable securing means, such as elastic bands, strings, rope, etc., without departing from the scope and spirit of the invention.

In the preferred embodiment of the archery apparatus 10, the second side 16 of the neck support 12 is shaped to generally conform to the archer's neck and the first side 21 of the handle 20 is shaped to generally receive a portion of the archer's fingers. It should be readily understood by those skilled in the art that the neck support 12 may be padded.

In the preferred embodiment of the archery apparatus 10, the release mechanism 30 is of the caliper type commercially available from Scott Archery Manufacturing, of Clay City, Ky., and known as the Quick Shot 1001E. A suitable release mechanism 30 is also generally disclosed and described in U.S. Pat. No. 8,146,578 which is incorporated by reference.

In operation, the release mechanism 30 is secured to the bowstring 50, the handle 20 is grasped by the drawing hand of the archer, with the other hand of the archer on the bow frame 54, the bowstring 50 is drawn by the archer to the generally fully drawn position so that the neck support 12 is selectively and supportably disposed against the archer's neck. Thus, both the manual muscular force exerted by the drawing arm of the archer and the force supplied by the neck support 12 are available in tandem for maintaining a bowstring 50 and associated arrow 52 in a generally fully drawn position. After aiming the associated arrow 52, the release mechanism 30 is actuated to provide the normal proper triggering of the associated arrow 52 into flight.

Figure 5:
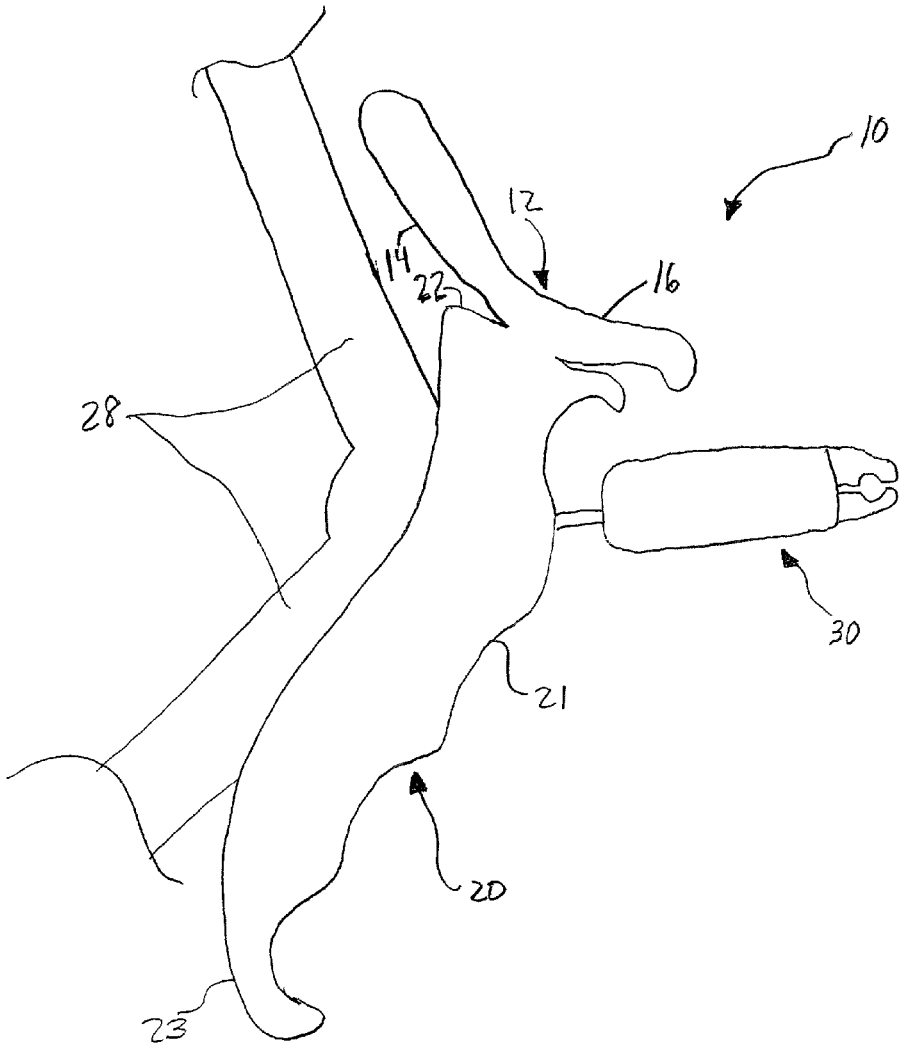
FIG. 5 is a top plan view of an archery apparatus in accordance with an alternate embodiment of the invention.

Referring now to FIG. 5, an alternate embodiment of the archery apparatus 10 includes an integrated neck support 12 and handle 20. It should also readily understood by those skilled in the art that a rigid, non-adjustable member may be substituted for the adjustable member 40 to secure the neck support 12 and handle 20 in spaced relationship without departing from the scope and spirit of the invention.

Hence, while the invention has been described in connection with a preferred embodiment and alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum proportions for the elements of the invention, and variations in size, materials, shape, form, function and manner of operation, assembly and use, are deemed readily apparent and obvious to one skilled in the art, and all equivalent relationships described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact method, construction and operation shown and described, and accordingly, all suitable modifications and equivalents may be resorted to, falling within the scope of the invention.

What is claimed is:

1. An archery apparatus comprising, in combination:

a neck support having a first side and a second side;

a handle having a first end, a first side and a second side;

and a release mechanism, said neck support, said handle and said release mechanism being connected and adapted to maintain a bowstring and associated arrow in a generally fully drawn position when said neck support is selectively and supportably disposed against the archer's neck.

2. The archery apparatus of claim 1 wherein:

an adjustable member is disposed in cooperative engagement between said first side of said neck support and said first end of said handle.

3. The archery apparatus of claim 2 wherein:

said neck support defines a threaded recess; and said adjustable member comprises a threaded bolt which is partially disposed in said threaded recess of said neck support.

4. The archery apparatus of claim 3 wherein:

said release mechanism is pivotally attached to said first side of said handle.

5. The archery apparatus of claim 3 wherein:

said neck support and said handle are secured in spaced relationship by a lock nut disposed on the adjustable member.

6. The archery apparatus of claim 3 wherein:

securing means are attached to said second side of said handle for selectively and releasably securing said handle to a wrist of an archer.

7. The archery apparatus of claim 3 wherein:

said second side of said neck support is shaped to generally conform to the archer's neck.

8. The archery apparatus of claim 3 wherein said neck support and handle are integrated.

9. The archery apparatus of claim 2 wherein:

said release mechanism is pivotally attached to said first side of said handle.

10. The archery apparatus of claim 9 wherein:

securing means are attached to said second side of said handle for selectively and releasably securing said handle to a wrist of an archer.

11. The archery apparatus of claim 2 wherein:

securing means are attached to said second side of said handle for selectively and releasably securing said handle to a wrist of an archer.

12. The archery apparatus of claim 2 wherein:

said second side of said neck support is shaped to generally conform to the archer's neck.

13. The archery apparatus of claim 2 wherein said neck support and handle are integrated.

14. The archery apparatus of claim 1 wherein:

said release mechanism is pivotally attached to said first side of said handle.

15. The archery apparatus of claim 14 wherein:

said second side of said neck support is shaped to generally conform to the archer's neck.

16. The archery apparatus of claim 14 wherein said neck support and handle are integrated.

17. The archery apparatus of claim 1 wherein:

securing means are attached to said second side of said handle for selectively and releasably securing said handle to a wrist of an archer.

18. The archery apparatus of claim 1 wherein:

said second side of said neck support is shaped to generally conform to the archer's neck.

19. The archery apparatus of claim 1 wherein said neck support and handle are integrated.

20. In a method of launching an arrow with an archery apparatus including, in combination, a neck support, a handle having a first side and a second side, and a release mechanism, the steps comprising:

a) securing said release mechanism to said bowstring;

b) the drawing hand of the archer grasping the handle;

c) with the other hand of the archer on the bow frame, the archer drawing the bowstring to the generally fully drawn position;

d) selectively and supportably disposing said neck support against the archer's neck;

e) aiming the associated arrow; and f) actuating said release mechanism to provide the normal proper triggering of the associated arrow into flight.

* * * * *